United States Patent [19]

Carlson et al.

[11] Patent Number: 4,777,649

[45] Date of Patent: Oct. 11, 1988

[54] ACOUSTIC FEEDBACK CONTROL OF MICROPHONE POSITIONING AND SPEAKING VOLUME

[75] Inventors: Ronald E. Carlson, Long Beach; Wilson B. Quan, Hawthorne, both of Calif.

[73] Assignee: Speech Systems, Inc., Tarzana, Calif.

[21] Appl. No.: 790,113

[22] Filed: Oct. 22, 1985

[51] Int. Cl.[4] ..... G10L 3/00

[52] U.S. Cl. ..... 381/46; 381/122

[58] Field of Search ..... 381/41–49, 381/74–76, 122; 379/391, 392

[56] References Cited

U.S. PATENT DOCUMENTS

| | | | |
|---|---|---|---|
| 3,480,912 | 11/1969 | Speeth et al. | 340/691 X |
| 4,158,750 | 6/1979 | Sakoe et al. | 381/43 |
| 4,357,491 | 11/1982 | Daaboul et al. | 381/46 |
| 4,445,229 | 4/1984 | Tasto et al. | 381/42 X |
| 4,662,847 | 5/1987 | Blum | 434/185 |
| 4,700,392 | 10/1987 | Kato et al. | 381/46 |

*Primary Examiner*—Patrick R. Salce
*Assistant Examiner*—Marc S. Hoff
*Attorney, Agent, or Firm*—Blakely, Sokoloff, Taylor & Zafman

[57] ABSTRACT

The present invention is directed to an apparatus and method which provide repeatable control of speech input to a microphone via audio feedback to a user. In this manner, repeatable and simultaneous control of microphone positioning and speaking volume is obtained. In a first embodiment, a microphone in the mouthpiece of the handset is used to detect sounds emanating from the mouth and audio feedback is provided through a speaker in the handset earpiece to ensure the microphone is positioned correctly for the application. In alternate embodiments, feedback is provided based upon voiced and unvoiced amplitudes of the input speech to obtain more optimal results.

20 Claims, 6 Drawing Sheets

Fig. 11
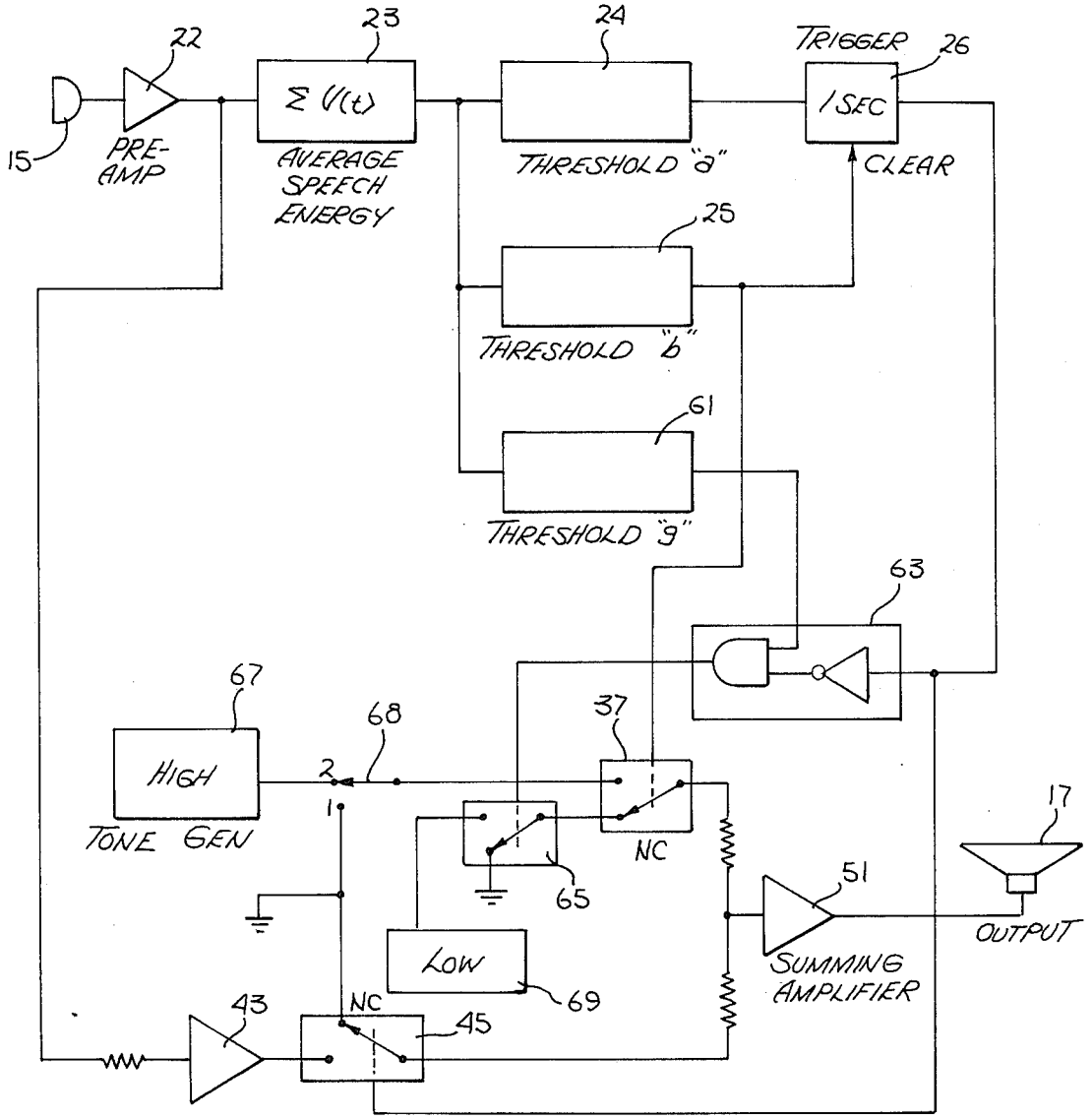
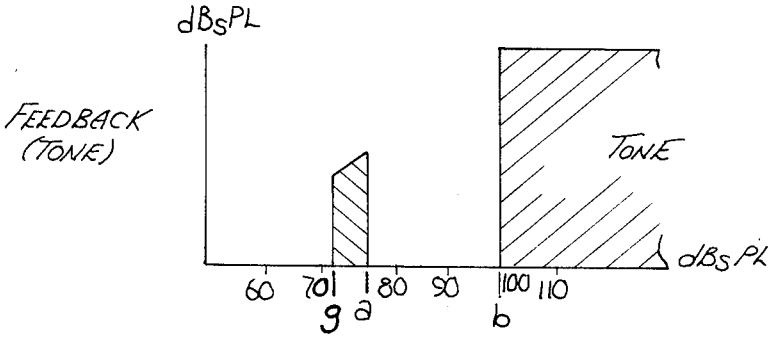
Fig. 8

ACOUSTIC FEEDBACK CONTROL OF MICROPHONE POSITIONING AND SPEAKING VOLUME

BACKGROUND

Some applications of speech processing require repeatable transduction of speech frequencies and a full range of speech volume. One such application is speech recognition. Another is speech compression (for applications such as "voice mail"). As such, methods for positioning microphones are needed to optimize acoustic performance of microphones for speech signal reception.

In order to receive consistent frequency response from a user, the microphone must be placed in a fixed position relative to the acoustic source, i.e. the mouth, the nose, etc. This eliminates methods using microphones fixed to position that is external to the sound source; for example, on a desk, boom, gooseneck, or lapel. Prior art methods to provide a fixed microphone position, relative to the source, have included throat microphones, head gear with a microphone extension (fixed or adjustable), and helmets with microphone elements fitted to the interior.

For some applications, prepositioned or adjustable headgear microphones such as the Shure SM-10 (U.S. Pat. No. 4,039,765) may be adequate. However, for voice recognition applications, consistent placement is not assured each time the speaker mounts the headgear. A second prior art solution proposed includes use of a microphone boom with a fitted ear clip; but as there is freedom of movement from 5–15 degrees, the microphone boom cannot be consistently positioned. Neither approach is convenient for usage in an office environment which may involve frequent removal of the microphone to leave the office, answer the telephone, etc.

Additionally, helmet mounted microphones require measurements of each user's head for proper size, mounting, and alignment. The helmet's weight and inconvenienee limits its general acceptability.

Other prior art devices include throat microphones (see, U.S. Pat. No. 2,340,777) which provide a fixed reference location. However, throat microphones do not provide clear reception of acoustic signals produced by articulations of the tongue, teeth or lips, nor is there any useful reception of nasal sounds.

SUMMARY OF THE INVENTION

The present invention is directed to an apparatus and method which provide repeatable control of speech input to a microphone via audio feedback to a user. In this manner, repeatable and simultaneous control of microphone positioning and speaking volume is obtained.

In particular, a method and apparatus are disclosed for detecting small variations in positioning of a microphone while allowing consistent placement of the microphone from ¼" to 1½" from themouthor other sound source.

The present invention utilizes a device similar to an ordinary telephone handset which is familiar to users and can be easily put down and picked up again to perform other tasks. However, differences in head size and methods of holding an ordinary telephone handset make microphone placement very irregular.

In a first embodiment, a microphone in the mouthpiece of the handset is used to detect sounds emanating from the mouth and audio feedback is provided through a speaker in the handset earpiece to ensure the microphone is positioned correctly for the application. In alternate embodiments, feedback is provided based upon voiced and unvoiced amplitudes of the input speech to obtain more optimal results.

BRIEF DESCRIPTION OF THE DRAWINGS

FIG. 8 is a transfer function diagram showing the feedback amplitude of a tone when the user cannot easily hear speech feedback when the average input speech energy is low.

FIG. 11 is a block diagram of a circuit implementing the transfer functions shown in FIGS. 4*a*, 4*b* and 8.

DETAILED DESCRIPTION OF THE INVENTION

Figure 1:
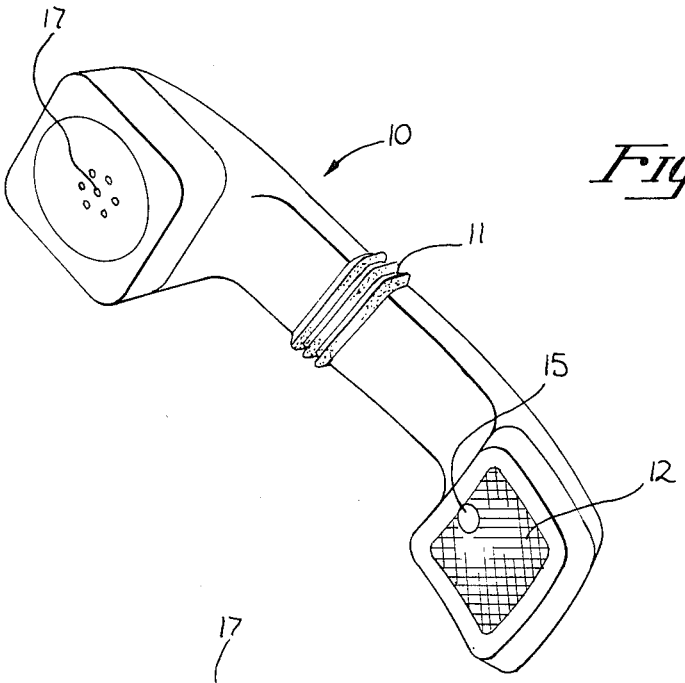
FIG. 1 is a perspective view showing a handset which may be utilized in the present invention.

A method and apparatus are disclosed for use in a speech processing system wherein the microphone or microphones used to detect the speech sounds are easily positioned to provide a consistent frequency range and volume of speech input. In a first embodiment, a microphone and feedback speaker are mounted in a device similar to a telephone handset 10 as shown in FIG. 1 The distance between the feedback speaker and the microphone is adjustable to allow for the variance found in people for the distance from the center of ear canal to the corner of mouth (similar to bitragional girth). This distance is variable by ¾ inch from the median distance. In this connection, a three step adjustment has been found adequate for most, if not all, people. A detented slip joint 11 has been found adequate to provide the necessary adjustment.

The user selects a distance setting for a comfortable fit to his or her head shape which correspondingly positions a microphone grill detail 12 toward the front of the mouth. The grill detail is configured to appear as if the microphone is located at its center since it has been found that typical users tend to hold the handset such that they talk directly into the grill. The microphone 15 is not where the user is led to believe it is (i.e. centered on the grill detail) to avoid the interfering noises from the volume velocity of air causing turbulence across the actual microphone, particularly for released consonants. In particular, the microphone 15 is positioned closer to the ear, centered around the corner of the mouth.

Figure 2:
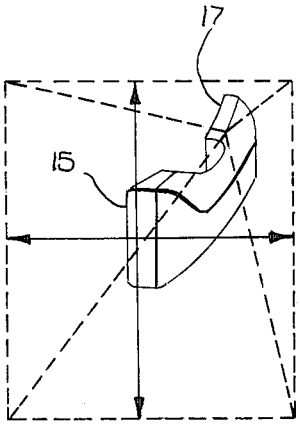
FIG. 2 is a diagram showing the solid angle thru which the handset may rotate during use.
Figure 3:
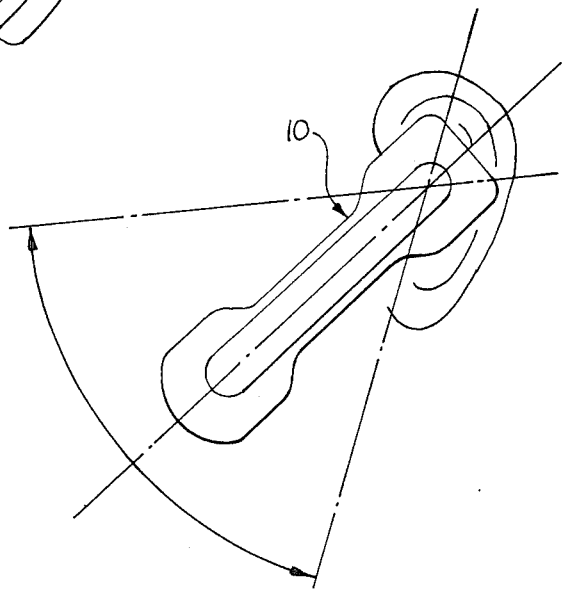
FIG. 3 is a view showing the two-dimensional angle thru which the handset may rotate during use.

As shown in FIG. 2 the microphone 15 is positioned by moving the handset anywhere in a solid angle with the pinae and ear canal at the approximate origin and centered over the feedback speaker 17 as best seen in FIG. 3.

Figure 4A:
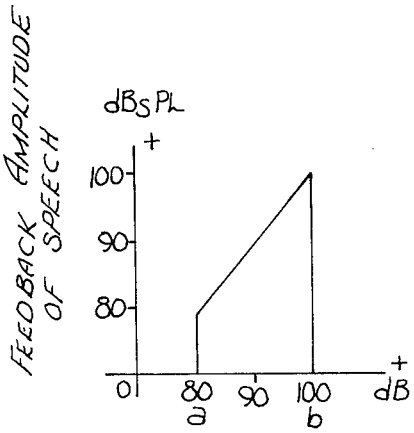
FIG. 4*a* is a transfer function diagram showing the feedback amplitude of speech when the average input speech energy is within acceptable limits.
Figure 4B:
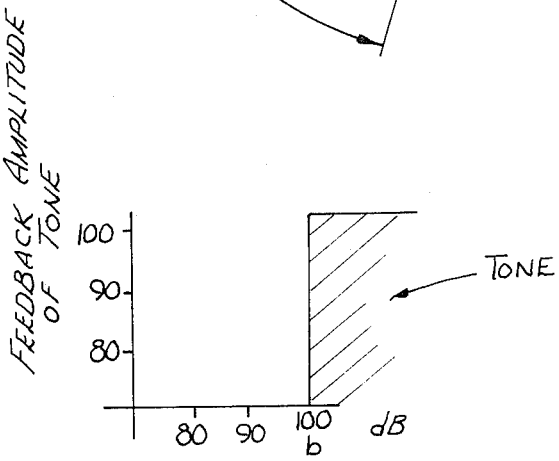
FIG. 4*b* is a transfer function diagram showing the feedback amplitude of a tone when the average input speech energy is above the maximum limit.
Figure 5A:
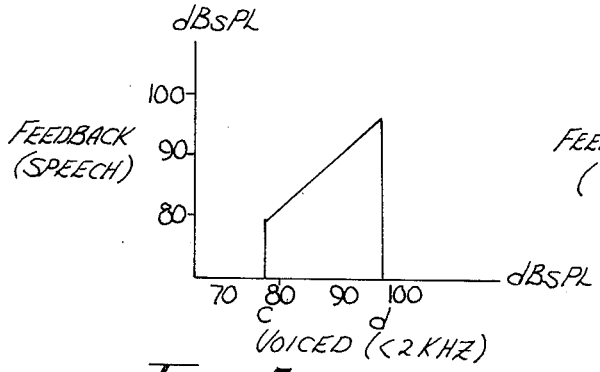
FIG. 5*a* is a transfer function diagram showing the feedback amplitude of speech when the voiced component of the average input speech energy is within acceptable limits.
Figure 5B:
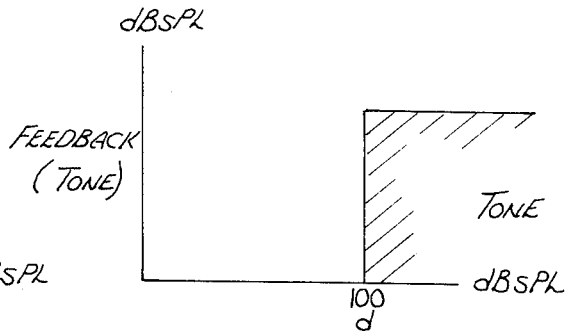
FIG. 5*b* is a transfer function diagram showing the feedback amplitude of a tone when the voiced component of the average input speech energy is above the maximum limit.
Figure 5C:
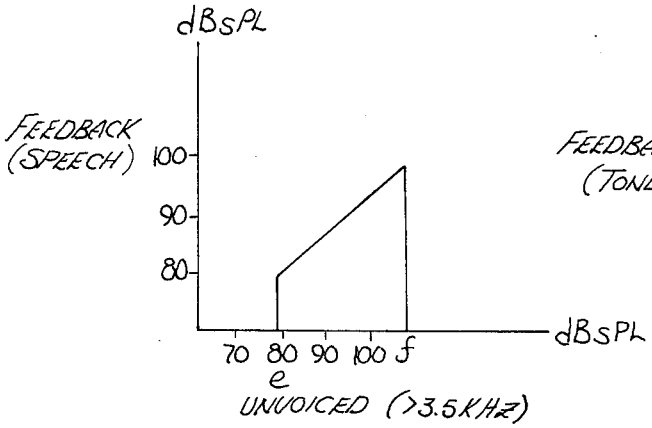
FIG. 5*c* is a transfer function diagram showing the feedback amplitude of speech when the unvoiced component of the average input speech energy is within acceptable limits.
Figure 5D:
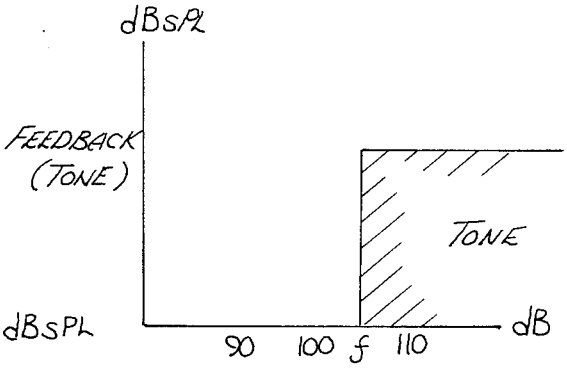
FIG. 5*d* is a transfer function diagram showing the feedback amplitude of a tone when the unvoiced component of the average input speech energy is above the maximum limit.

In order to intuitively guide the user to position the microphone into the desired region, a transfer function is defined for feedback of the user's voice to the speaker such as shown in FIGS. 4*a* and 4*b*.

The user hears the sum of these two functions through speaker 17. The transfer function shown in FIG. 4*a* can be explained as follows: when the microphone is too far (averaged speech level less than "a") the feedback speech is muted (or replaced with another type of feedback as described below); when the microphone is too close (averaged speech level greater than "b") the feedback speech is muted (or replaced with another type of feedback such as a tone as shown in FIG. 4*b* and described below) to simulate "inoperation." The placement of, and separation between thresholds "a" and "b" can be varied to define the solid angle around the reference origin of the ear of allowed microphone positions. Typically, threshold "a" is approximately 80 dB SPL and threshold "b" is approximately 100 dB SPL. The feedback transfer function is defined with threshold "a" having a short onset time of 20 msec for enabling feedback, with a longer hold time of 1 second. This leads the user to believe the handset does not work if it is held too close or too far away.

The nonlinear sound pressure level gradient that projects from around the mouth is utilized as a correlated function of the microphone's distance from the mouth. The nonlinear gradient from the side of the mouth provides more sensitivity for close positioning than does the more linear field projecting from the front of the mouth. Thus the positioning of the microphone as described above augments the effectiveness of the invention.

The correct distance range is controlled by selecting thresholds "a" and "b" to correspond to the average root mean square ("RMS") sound pressure levels found in the sound pressure gradient projecting from the side of the mouth. The gradient levels can be found by direct measurement with a precision sound pressure level meter.

This feedback transfer function is also used to eliminate high variance "outliers" in the normal distribution of users' averaged speech volume. Without any control, a speech processing system might require from 16 dB to 48 dB of gain control range (as in the General Instruments SP-1000 integrated circuit for speech analysis), and a very quiet environment to provide full dynamic range of the speech signal vs. background noise. It is an objective of this invention to reduce this required range to a more practical level of approximately 12 dB.

Most users find it most comfortable to hold the handset in a "rest position," close to the face perhaps touching the ear, cheek, and lip or chin area. This position is encouraged by the feedback thresholds, as it is difficult to achieve consistent comfortable operation while holding the handset away from this "rest position." Of course, a user whose averaged speech energy is too low cannot move the microphone any closer than the "rest position" and must increase his or her speech volume to achieve acceptable operation.

Spoken sentences or phrases are typically spoken in "breath groups" where the user uses the last inhalation of air. This has the effect of producing a negative slope with increasing time in the averaged speech amplitude during each breath group as the subglottal pressure diminishes. Thus, initial energy tends to be highest in the first few phonemes.

The audio feedback is sustained for one second if the initial energy is above threshold "a" even if subsequent averaged energy falls below threshold "a" within the one second hold time. Any subsequent averaged amplitudes above threshold "a" provide an additional one second of feedback.

Experiments with this feedback system demonstrated reduced kurtosis of the normal distribution by 30% and selectable control over the users' mean averaged speech energy by ±3 dB.

A second and preferred embodiment of the audio feedback technique described above refines the average speech amplitude thresholds "a" and "b." Since voiced and unvoiced speech (generally equivalent to vowels and consonants) are produced by different means, the relative amplitude of each is controlled by different and somewhat uncorrelated factors.

The ratio of voiced to unvoiced amplitude can vary between speakers by 24 dB, with some speaker's unvoiced speech amplitudes as much as 12 dB greater than voiced. Most users are not able to control this ratio, but can control subglottal pressure to control the overall volume. Therefore, averaged voiced amplitude can be used as a measure of subglottal pressure for the feedback thresholds as a correlate of microphone position.

In this second embodiment, control logic is used to integrate energies in the frequency ranges of voiced (less than 2 KHz) and unvoiced (greater than 3500 Hz) speech, with independently controllable attack and decay time for each.

The transfer function now has four thresholds as shown in FIG. 5*a*–5*d* for voiced and unvoiced feedback amplitude of speech and voiced and unvoiced feedback amplitude of tone.

Thresholds "d" and "f" represent the maximum allowable input amplitude. Similarly, thresholds "c" and "e" represent the minimum allowable input amplitudes before the application and/or automatic gain control is affected by too low a signal to noise ratio.

In a manner similar to the onset and hold for threshold "a" as described above, threshold "c" for voiced speech has an onset delay of 20 msec and a retriggerable hold of 1 sec. Threshold "e" for unvoiced speech has an onset of 10 msec and a retriggerable hold of 100 msec.

An additional variation to both threshold function approaches is the type of feedback provided. If the user hears his own speech with little amplitude or phase distortion, the feedback speech amplitude has to be raised in order to hear it above external acoustic feedback and internal bone conduction. Feedback can reach uncomfortable levels for the user. In this connection, a filter can be used to frequency limit the feedback signal and introduce distortion to allow intelligible feedback at a comfortable reduced volume level.

The feedback provided for average amplitudes below thresholds "a," "c," and "e" and/or above thresholds "b," "d," and "f" can be muting or tones, or various combinations of both muting and tones. Users responded better in tests with muting below thresholds "a," "c," or "e" and a tone for thresholds above "b," "d," or "f."

Figure 6:
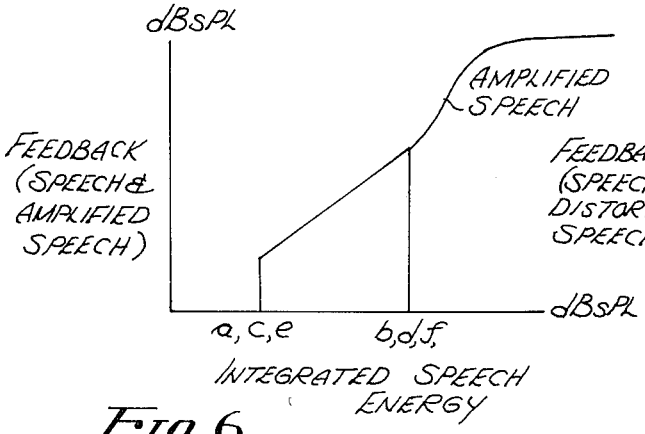
FIG. 6 is a transfer function diagram showing the feedback amplitude of speech using supergain when the average input speech energy is above the maximum limit.

The feedback for exceeding the maximum thresholds can also be what is termed "super gain" where the feedback volume is increased into an uncomfortable region prompting the user to hold the handset in the correct position to reduce the speaking volume. The transfer function in this case would be as shown in FIG. 6.

Figure 7:
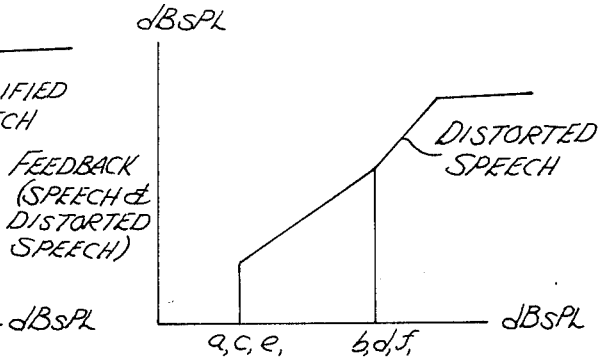
FIG. 7 is a transfer function diagram showing the feedback amplitude of speech using distortion when the average input speech energy is above the maximum limit.

The feedback for exceeding the maximum thresholds can also be a significant increase in distortion in the speech used as feedback. The transfer function in this case would be as shown in FIG. 7.

Another technique that can be used to inform the user that the feedback is ON instead of muted is the addition of low level white noise to the feedback signal at about −30 dB below the level of threshold "d." This then limits the maximum signal to noise ratio the user hears causing it to be clearly different from other feedback paths to the ear.

In a further refinement which can be implemented in both of the above described embodiments, an enhanced threshold detection method is utilized for the "too far" position of the microphone or "too soft" speaking level of the user to assist users who do not easily hear the feedback due to hearing impairment or a very low speaking level. In particular, in this further refinement, a tone is fed back when voicing is present, but is below threshold "a" (or threshold "c" or "e") as shown in the transfer function of FIG. 8. In this manner, a user who speaks into the handset microphone who either has a hearing impairment or speaks softly hears a tone when the speech level is above threshold "g" but below threshold "a" (or threshold "c" or "e").

In addition, the dynamic range of the speech relative to the background noise level can be controlled by adjusting the thresholds based on measured energy during the times when the user is not speaking into the handset. The difference between the minimum and maximum thresholds in the one channel voicing detector embodiment, and also in the voiced/unvoiced speech voicing detector embodiment is constant. Thus, when a lower threshold is changed the upper threshold tracks. It should be recognized that the adjustment control could come from the speech processing application or be locally generated.

In both embodiments, the audio signal sent from the microphone to the speech processing application does not include any of the feedback which the user hears through the feedback speaker. Therefore, the audio sent to the speech processing system is unaffected by the feedback except for the desired effect of consistent frequency and amplitude response.

Figure 9:
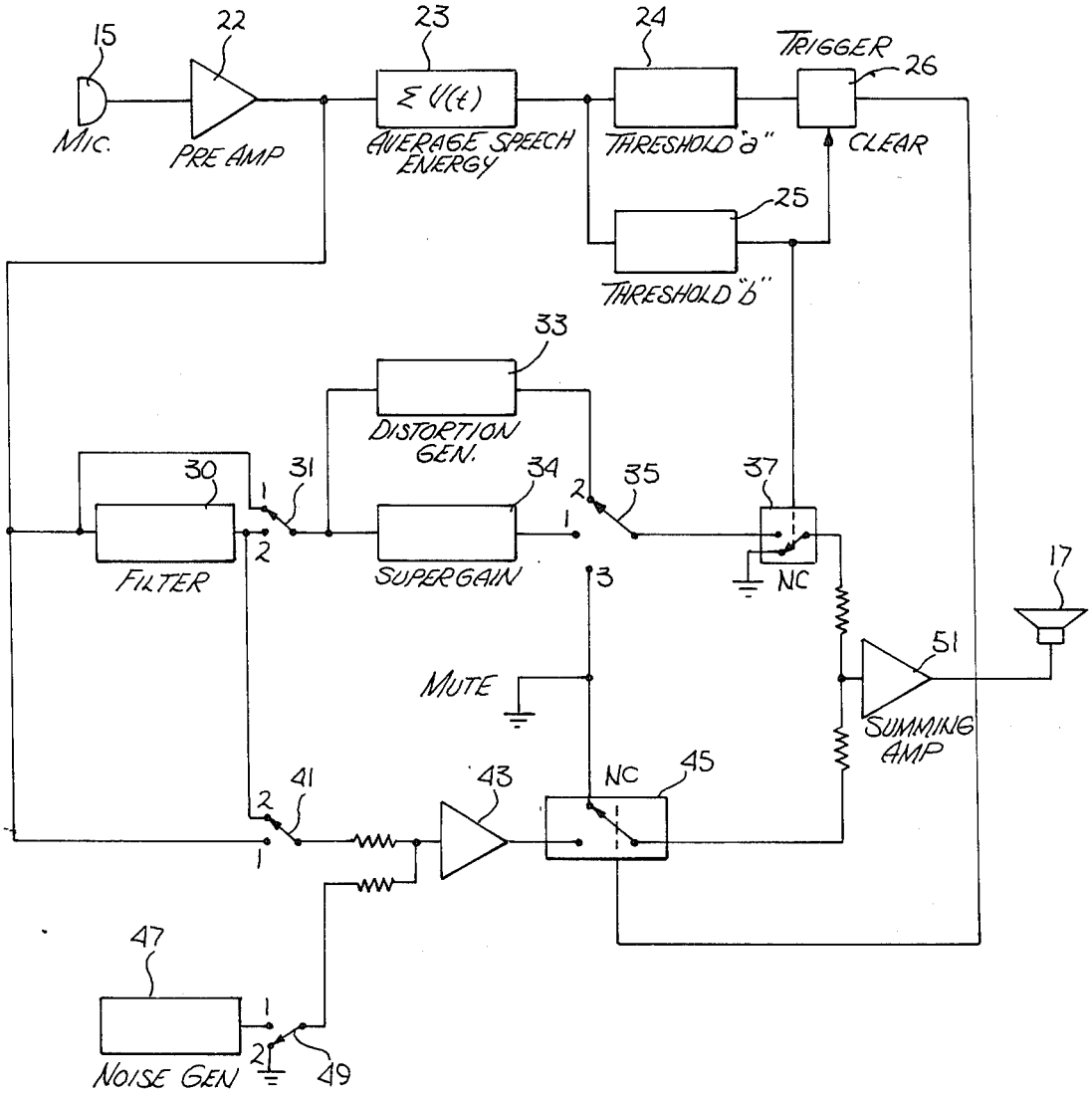
FIG. 9 is a block diagram of a circuit implementing the transfer functions shown in FIGS. 4*a*, 6 and 7.

A block diagram of a circuit which may be used to provide feedback based upon the transfer functions as shown in FIGS. 4*a*, 6 and 7 is illustrated in FIG. 9. Speech sound detected by microphone 15 is amplified by amplifier 22. The output of amplifier 22 is averaged by average speech energy circuit 23 and is input into threshold "a" detector 24 and threshold "b" detector 25. The output of amplifier 22 is also input to switch 31 both directly and through filter 30 (lowpass filter with a 1–3 pole rolloff above 2500 Hz) and to switch 41. Switch 31 is coupled to distortion generator 33 and supergain 34, the outputs of which are connected to three position switch 35 which, in turn, is coupled to control switch 37. Noise generator 47 is coupled through switch 49 to amplifier 43 and switch 41. The output of amplifier 43 is coupled to control switch 45, a two position switch, the other position of which is coupled to the third position of three position switch 35. Switches 37 and 45 are coupled to summing amplifier 51, the output of which is the feedback sent to speaker 17. The output of threshold "a" detector passes through a one second delay trigger 26 before being coupled to switch 45. The output of threshold "b" detector is coupled to control switch 37. A clear signal from threshold "b" is also connected to switch 45.

The following description will set forth how the various types of feedback available are obtained by use of the circuit shown in FIG. 9. During speech that exceeds threshold "b" (indicating that the microphone is being held too closely to the mouth), switch 37 is closed by the output of threshold "b" detection circuit 25 in order to feedback to the user one of five processed versions of the input speech signal as the microphone position indicator and switch 45 is reset to not sum in normal operation feedback. Switch 37 remains closed until the threshold "b" limit is no longer being exceeded. The selection of one of the five processed versions of the input speech is provided depending upon the positions of switches 35 and 31 as follows:

| Type | Switch 35 Position | Switch 31 Position |
|---|---|---|
| 1. Unfiltered speech with distortion as feedback | 2 | 1 |
| 2. Unfiltered speech with supergain as feedback | 1 | 1 |
| 3. Silence as feedback | 3 | don't care |
| 4. Filtered speech with supergain | 1 | 2 |
| 5. Filtered speech with distortion | 2 | 2 |

During speech that exceeds threshold "a" but which is less than threshold "b" (indicating acceptable positioning of the handset microphone), control switch 37 is opened (i.e. connected to ground) and control switch 45 is closed such that one of four types of feedback are provided as follows:

| Type | Switch 41 Position | Switch 49 Position |
|---|---|---|
| 6. Unprocessed speech as feedback | 1 | 2 |
| 7. Unprocessed speech with additive noise as feedback | 1 | 1 |
| 8. Processed speech (lowpass filtered) as feedback | 2 | 2 |
| 9. Processed speech (lowpass filtered) | 2 | 1 |

-continued

| Type | Switch 41 Position | Switch 49 Position |
|---|---|---|
| with additive noise as feedback | | |

Most people find type 4 and type 9 feedback provide the best combination to allow for easy determination of proper microphone positioning. When the speech input is less than threshold "a," switches 37 and 45 are opened and no feedback is provided.

Figure 10:
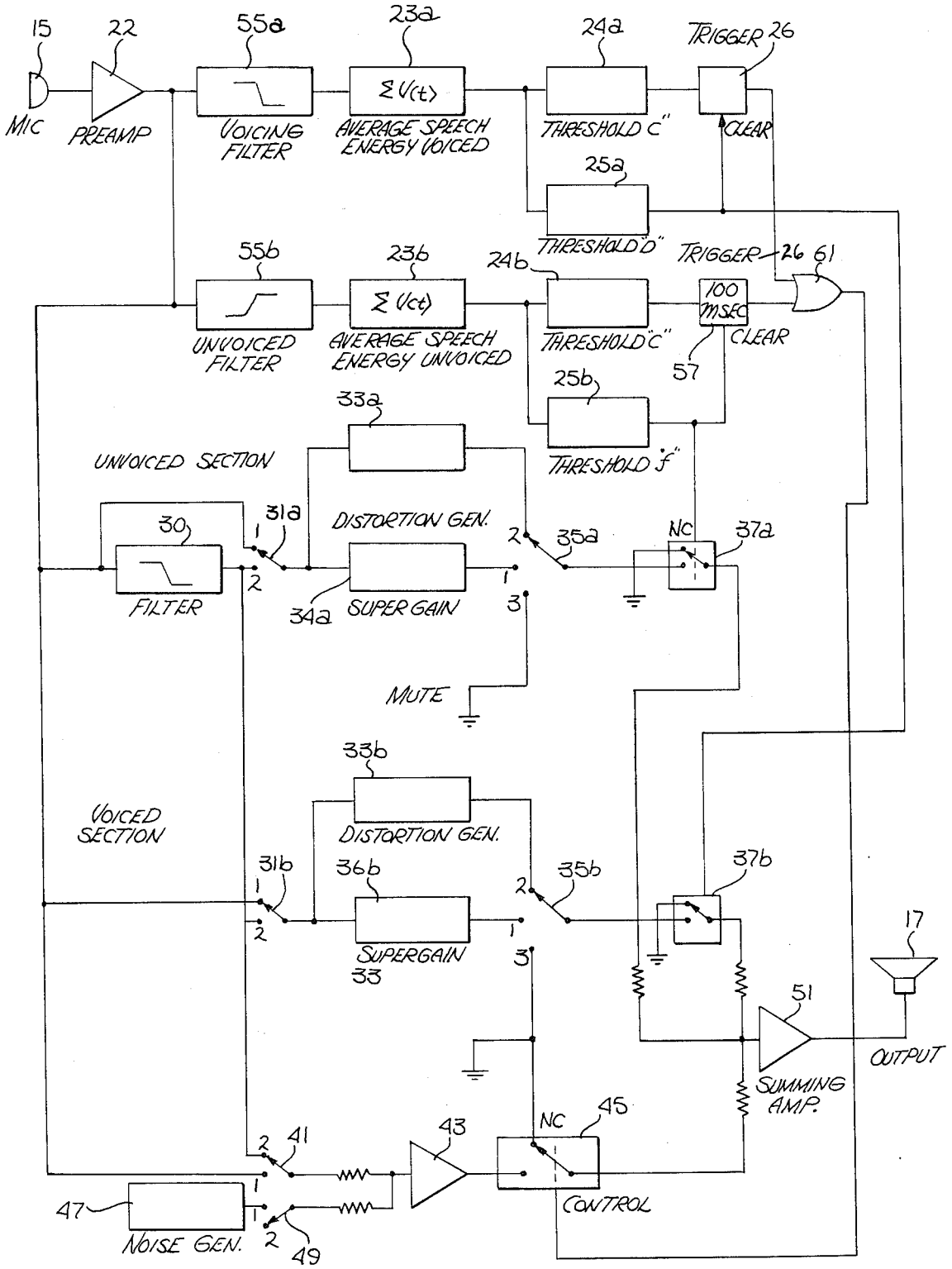
FIG. 10 is a block diagram of a circuit implementing the transfer functions shown in FIGS. 5*a*, 5*c*, 6 and 7.

A block diagram of a circuit which may be used to provide feedback based upon the transfer functions as shown in FIGS. 5*a*, 5*c*, 6 and 7 is illustrated in FIG. 10. In this second embodiment, the input speech signal is divided into two components namely voiced components and unvoiced components. This is accomplished by filtering the unprocessed speech signal through voicing filter 55*a* (similar to lowpass filter 30) for the voiced component and through unvoiced filter 55*b* (highpass filter with a 1–3 pole rolloff below 2500 Hz) for the unvoiced component. The elements in FIG. 10 function substantially identically to the correspondingly numbered elements in FIG. 9. Thus, for example, blocks 23*a* and 23*b* produce an average of the input speech energy as does block 23 in FIG. 9, with block 23*a* averaging voiced speech energy and block 23*b* averaging unvoiced speech energy. In addition, the circuit of FIG. 10 includes a 100 msec trigger 57 for the unvoiced portion of the signal which performs a similar function as does the 1 second trigger 26 for the voiced portion of the signal. The outputs of triggers 26 and 57 are input to OR gate 61, the output of which opens and closes control switch 45.

The following description will set forth how the various types of feedback available are obtained by use of the circuit shown in FIG. 10. During unvoiced speech that exceeds threshold "f" (indicating that the handset microphone is being held too closely), control switch 37*a* is closed by the output of threshold detection circuit 25*b* in order to feedback to the user one of five processed versions of the speech as the microphone position indicator. Control switch 37*a* remains closed until the threshold "f" is no longer being exceeded. The selection of one of the five processed versions of the input speech is provided depending upon the positions of switches 31*a* and 35*b* as follows:

| Type | Switch 35a Position | Switch 31a Position |
|---|---|---|
| 1. Unfiltered speech with distortion as feedback | 2 | 1 |
| 2. Unfiltered speech with supergain as feedback | 1 | 1 |
| 3. Silence as feedback | 3 | don't care |
| 4. Filtered speech with supergain | 1 | 2 |
| 5. Filtered speech with distortion | 2 | 2 |

During voiced speech that exceeds threshold "d" (indicating that the handset microphone is being held to closely), control switch 37*b* is closed by the output of threshold detection circuit 25*a* in order to feedback to the user one of five processed versions of his speech as the microphone position indicator. Control switch 37*b* remains closed until the threshold "d" is no longer being exceeded. The selection of one of the five processed versions of the input speech in provided depending upon the positions of switches 31*b* and 35*b* as follows:

| Type | Switch 35b Position | Switch 31b Position |
|---|---|---|
| 1. Unfiltered speech with distortion as feedback | 2 | 1 |
| 2. Unfiltered speech with supergain as feedback | 1 | 1 |
| 3. Silence as feedback | 3 | don't care |
| 4. Filtered speech with supergain | 1 | 2 |
| 5. Filtered speech with distortion | 2 | 2 |

During speech that exceeds threshold "c" and threshold "e" and is less than threshold "d" and threshold "f" (indicating normal positioning of the handset microphone), control switches 37*a* and 37*b* are open and control switch 45 is closed such that one of four types of feedback are provided as follows:

| Type | Switch 41 Position | Switch 49 Position |
|---|---|---|
| 6. Unprocessed speech as feedback | 1 | 2 |
| 7. Unprocessed speech with additive noise as feedback | 1 | 1 |
| 8. Processed speech (lowpass filtered) as feedback | 2 | 2 |
| 9. Processed speech (lowpass filtered) with additive noise as feedback | 2 | 1 |

A block diagram of a circuit which may be used to provide feedback based upon the transfer functions as shown in FIGS. 4*a*., 4*b* and 8 is illustrated in FIG. 11. In particular, the circuit of FIG. 11 provides a tone feedback when the average input speech energy is between threshold "g" and threshold "a" which, as described above, is desirable when the user cannot easily hear speech feedback when the average input speech energy is low. Additionally, it should be recognized that adding the transfer function of FIG. 8 to the circuits of FIGS. 9 or 10 can be easily accomplished if desired by a person of ordinary skill in the art.

The following description will set forth the types of feedback available by use of the circuit shown in FIG. 11. During speech that exceeds threshold "b" (indicating that the microphone is being held too closely to the mouth, i.e. speech too loud), control switch 37 is closed by the output of threshold "b" detection circuit 25. The type of feedback provided when threshold "b" is exceeded is determined by the position of switch 68 as shown in the following table:

| Type | Switch 68 Position |
|---|---|
| 1. Silence as feedback | 1 |
| 2. High pitched tone as feedback | 2 |

During speech that exceeds threshold "a" but which is less than threshold "b" (indicating acceptable positioning of the headset microphone and an acceptable input speech level), control switch 37 is opened (i.e. connected to ground) and switch 45 is closed which thereby provides unprocessed speech through amplifier 43 as the feedback.

During speech that exceeds threshold "g" but which is less than threshold "a" (indicating that speech is present but is at a level below the acceptable limit of threshold "a"), control switches 37 and 45 are open (i.e. connected to ground) which is the same position which such switches are in when there is no input speech at all. However, when the input speech level exceeds threshold "g" as determined by threshold "g" detection circuit 61, logic circuit 63 generates a signal which closes control switch 65 thereby connecting the output of tone generator 69 to summing amplifier 51. As a result, a low pitched tone is output through speaker 17. As soon as threshold "a" is exceeded, trigger 26 generates a signal which closes switch 45 connecting normal feedback to summing amplifier 51 and which when inverted by the inverter in logic circuit 63 causes the AND gate in logic circuit 63 to output a zero which causes control switch 65 to open and thereby remove the low pitched tone generated by tone generator 69 from the output.

While tone generators 67 and 69 could generate tones having the same pitch or tone generator 69 could be made to generate a higher pitch tone than tone generator 67, it has been found that using a low pitched tone to signal when the input speech energy is too low and a high pitched tone when the input speech energy is too high is the most effective way to communicate to the user that the input speech level is outside the acceptable limits. Additionally, other types of feedback such as distorted speech or amplified speech as described in the circuits of FIGS. 9 and 10 can be substituted for the tone feedback provided in the circuit of FIG. 11.

Figure 12:
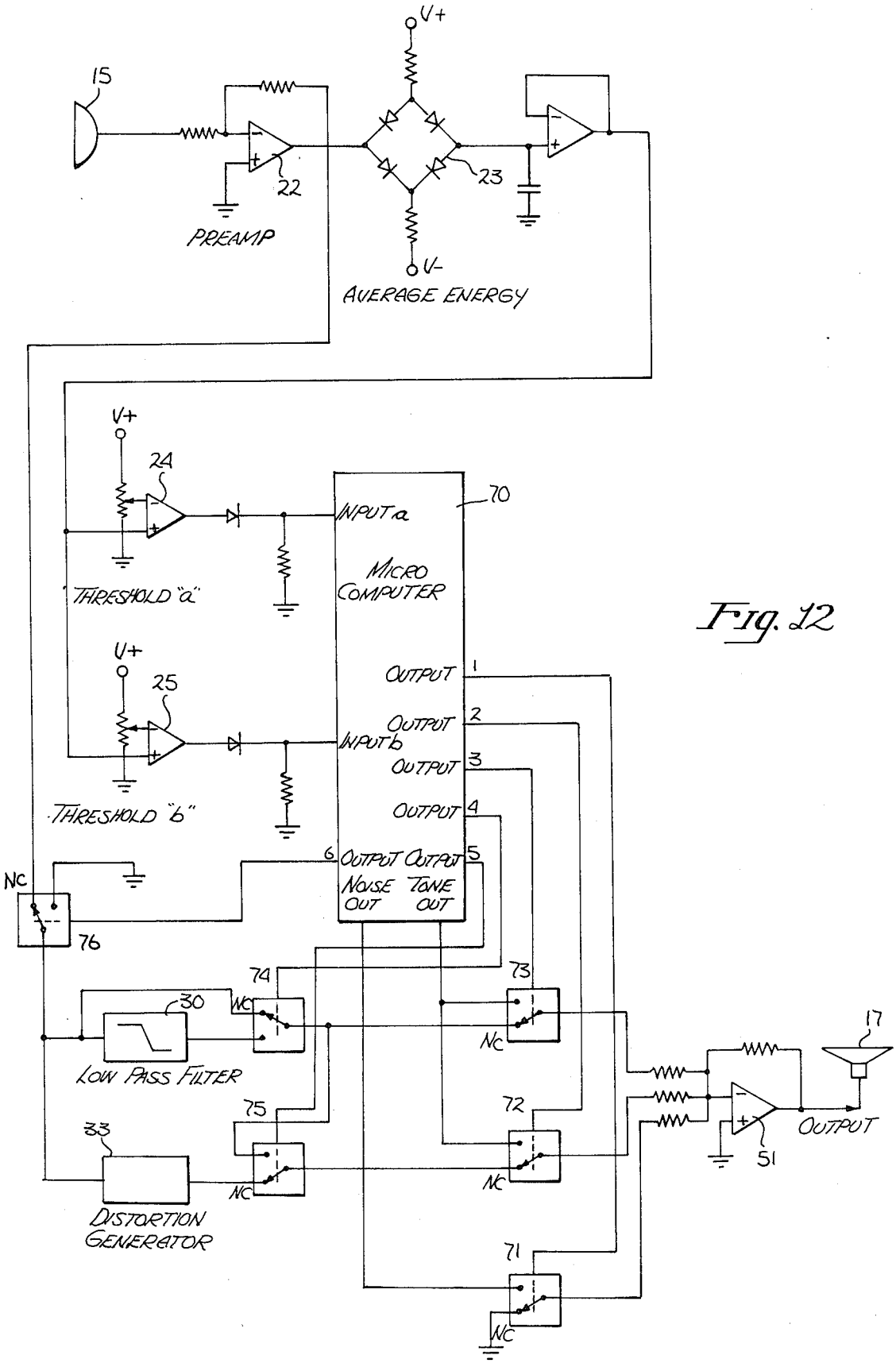
FIG. 12 is block diagram of an implementation of the circuit of FIG. 9 using a microcontroller.

The circuits of FIGS. 9 and 10 and 11 can be easily implemented utilizing a readily available microcontroller such as a Zilog 8613 Z8 microcontroller See, for example, FIG. 12 which is a microcontroller implementation of the circuit of FIG. 9. Components having corresponding numbers in FIGS. 9 and 12 having corresponding functions. That is, a microcontroller can be used to perform the switch control functions based upon the outputs of threshold "a" detection circuit 24 and threshold "b" detection circuit 25.

In particular, by utilizing control switches 71 through 76, coupled to controlled outputs 1 through 6 of microcontroller 70 and wherein low pass filter 30 is coupled to switch 74, distortion generator 33 is coupled to switch 75, and microcontroller noise output 81 is coupled to switch 71 and microcontroller tone output 83 is coupled to switch 72 as shown in FIG. 12, the circuit of FIG. 12 can perform the following functions based upon the settings of switches 71–76.

| Switch | Function |
|---|---|
| 71 | When selected, adds noise to normal feedback to enhance perceptual difference from speech heard by conduction. |
| 72 | Selects tone or speech as feedback in the microphone too close position. |
| 73 | Selects tone or speech as feedback in the microphone too distant position. |
| 74 | Selects unprocessed speech or processed speech as feedback when the microphone is within acceptable operating distance. |
| 75 | Selects distorted speech or processed speech as feedback for the microphone too close position. |
| 76 | Selects unprocessed speech or mute as speech input. |

The following table sets forth the preferred settings for switches 71–76 for each of the possible outputs of threshold "a" detection circuit 24 and threshold "b" detection circuit 25 along with the microphone distance condition which determines the outputs of threshold detection circuits 24 and 25. In the following table, "low" designates below threshold, and "high" designates above threshold. Similarly, with respect to outputs 1–6, "0" designates the normally closed position of the corresponding switch; "1" designates the other position of the corresponding switch; and "X" is a don't care condition.

| Microphone Distance Condition | Threshold "a" | Threshold "b" | Outputs 1 | 2 | 3 | 4 | 5 | 6 |
|---|---|---|---|---|---|---|---|---|
| too far or no speech | low | low | 0 | 0 | 0 | X | X | 1 |
| correct distance | high | low | 1 | 0 | 0 | 1 | 1 | 0 |
| too close | high | high | 0 | 1 | 0 | 1 | 1 | 1 |

Of course, the condition of threshold "a" detection circuit 24 "low" and threshold "b" detection circuit 25 "high" cannot exist and is not set forth in the table.

In a similar manner, the circuit of FIG. 10 which splits the incoming speech into voiced and unvoiced sections and utilizes two additional threshold detection circuits and the circuit of FIG. 11 which generates a feedback signal when low level speech is present can also be easily implemented in a microcontroller based circuit by persons of ordinary skill in the art.

It should be recognized that a positive, negative or absolute value amplitude measurement can be substituted for an average speech energy measurement. Timing of the average speech energy and feedback responses would vary, but performance can be made to be substantially the same. Such amplitude measurements could come from analog or digitized measurements.

Thus, a method and apparatus for acoustic feedback control of microphone positioning and speaking volume has been disclosed. Although numerous specific details have been set forth such as types of feedback which can be utilized, frequencies and the like, those skilled in the relevant art will recognize that such specifics are not necessary to practice the invention as disclosed herein and defined in the following claims.

We claim:

1. In a speech processing system, including speech detection means, an apparatus for maintaining input speech energy within first and second predetermined limits comprising:

first threshold detection means for detecting when said input speech energy is above said first predetermined limit;

second threshold detection means for detecting when said input speech energy is above said second predetermined limit;

feedback means coupled to said first and second threshold detection means for inhibiting feedback when said input speech energy is below said first predetermined limit, feeding back speech detected by said speech detection means when said input speech energy is above said first predetermined limit and below said second predetermined limit, and feeding back a predetermined signal when said input speech energy is above said second predetermined limit.

2. The apparatus defined by claim 1, wherein said first threshold detection means comprises a first threshold detection circuit into which said input speech energy is input, a delayed trigger coupled to the output of said first threshold detection circuit, and a first control switch coupled to said delayed trigger, and wherein said second threshold detection means comprises a second threshold detection circuit into which said input speech energy is input and a second control switch coupled to the output of said second threshold detection circuit.

3. The apparatus defined by claim 1 further comprising a distortion generating means and an amplifying means, each having an input coupled to said speech detection means and an output coupled to a first selector switch for selecting between said distortion generating means and said amplifying means, said first selector switch coupled to said second control switch whereby the predetermined signal generated by said feedback means when said input speech energy is above said second predetermined limit is one of said speech detected by said speech detection means distorted by said distortion generating means, and said speech detected by said speech detection means amplified by said amplifying means.

4. The apparatus defined by claim 2 further comprising filter means coupled to said speech detection means and to a second selector switch and to a third selector switch which is coupled to said first control switch by said second selector switch, whereby feedback generated by said feedback means when said input speech energy is between said first predetermined limit and said second predetermined limit is selectively one of said speech detected by said speech detection means and said speech detected by said speech dectection mean which has been filtered by said filter means.

5. The apparatus defined by claim 2 further comprising noise generating means coupled to a fourth selector switch coupled to said first control switch means whereby noise is selectively added to the speech detected by said speech detection means as feedback generated by said feedback means when said input speech energy is between said first predetermined limit and said second predetermined limit.

6. In a speech processing system including speech detection means, an apparatus for maintaining voiced input speech energy between first and second predetermined limits and unvoiced input speech energy between third and fourth predetermined limits comprising:

first threshold detection means for detecting when said voiced input speech energy is above said first predetermined limit;

second threshold detection means for detecting when said voiced input speech energy is above said second predetermined limit;

third threshold detection means for detecting when said unvoiced input speech energy is above said third predetermined limit;

fourth threshold detection means for detecting when said unvoiced input speech energy is above said fourth predetermined limit;

feedback means coupled to said first, second, third and fourth threshold detection means for inhibiting feedback when one of said voiced input speech energy is below said first predetermined limit and said unvoiced input speech energy is below said third predetermined limit, feeding back speech detected by said speech detection means when said voiced input speech energy is above said first predetermined limit and below said second predetermined limit and said unvoiced input speech energy is above said third predetermined limit and below said fourth predetermined limit and feeding back a predetermined signal when one of said voiced input speech energy is above said second predetermined limit and said unvoiced input speech energy is above said fourth predetermined limit.

7. The apparatus defined by claim 6 wherein said first threshold detection means comprises a first threshold detection circuit into which said voiced speech energy is input, a first delayed trigger coupled to the output of said first threshold detection circuit and a first control switch coupled to said delayed trigger, and wherein said second threshold detection means comprises a second threshold detection circuit into which said voiced speech energy is input and a second control switch coupled to the output of said second threshold detection circuit;

and wherein said third threshold detection means comprises a third threshold detection circuit into which said unvoiced speech energy is input, a second delayed trigger coupled to the output of said third threshold detection circuit and to said first control switch, and wherein said fourth threshold detection means comprises a fourth threshold detection circuit into which said unvoiced speech energy is input, and a third control switch coupled to the output of said fourth threshold detection circuit.

8. The apparatus defined by claim 7 wherein the outputs of said first and second delayed triggers are coupled to said first control switch through an OR gate.

9. In a speech processing system including speech detection means, an apparatus for maintaining input speech energy within first and second predetermined limits comprising:

first threshold detection means for detecting when said input speech energy is above a third predetermined limit which is less than said first predetermined limit;

second threshold detection means for detecting when said input speech energy is above said first predetermined limit;

third threshold detection means for detecting when said input speech energy is above said second predetermined limit;

feedback means coupled to said first, second and third threshold detection means for inhibiting feedback when said input speech energy is below said first predetermined limit, feeding back a first feedback signal when said input speech energy is above said third predetermined limit and below said second predetermined limit, feeding back speech detected by said speech detection means when said input speech energy is above said second predetermined limit and below said third predetermined limit, and feeding back a second feedback signal when said input speech energy is above said third predetermined limit.

10. The apparatus defined by claim 9 wherein said first threshold detection means comprises a first threshold detection circuit into which said speech energy is input, a delay trigger coupled to the output of said first threshold detection circuit, and a first control switch coupled to said delay trigger, and wherein said second threshold detection means comprises a second threshold detection circuit into which said speech energy is input and a second control switch coupled to the output of said second threshold detection circuit, and wherein said third threshold detection means comprises a third threshold detection circuit into which said speech energy is input, logic circuit means coupled to the output of said third threshold detection circuit and said delay trigger, the output of said logic circuit being coupled to a second control switch.

11. The apparatus defined by claim 10 further comprising tone generator means coupled to a first selector switch which selectively couples said second control switch to said tone generator means whereby a tone is generated as said second feedback signal when said input speech energy is above said second predetermined limit.

12. The apparatus defined by claim 10 further comprising tone generator means coupled to said second control switch whereby a tone is generated as said first feedback signal when said input speech energy is between said third predetermined limit and said first predetermined limit.

13. The apparatus defined by claim 10 further comprising a first tone generator means coupled to a selector switch for selectively coupling the output of said first tone generator means to said second control switch and a second tone generator means coupled to said second control switch whereby feedback is inhibited when said input speech level is below said third predetermined limit, said feedback is a first tone generated by said first tone generator means when said input speech energy is above said third predetermined limit and below said first predetermined limit, said feedback is said speech detected by said speech detection means, and said feedback when said input speech energy is above said second predetermined limit is selectively one of being inhibited and a second tone generated by said second tone generator means.

14. In a speech processing system, including speech detection means, an apparatus for maintaining input speech energy within first and second predetermined limits comprising:

first threshold detection means for detecting when said input speech energy is above said first predetermined limit;

second threshold detection means for detecting when said input speech energy is above said second predetermined limit; microprocessor means having the output of said first threshold detection means as a first input and the output of said second threshold detection means as a second input, said microprocessor means having a first plurality of output, coupled to a second plurality of control switch means whereby feedback is inhibited when said input speech energy is below said first and second predetermined limits, the speech detected by said speech detection means is fed back when said input speech energy is above said first predetermined limit and below said second predetermined limit, and a predetermined feedback signal is generated when said input speech energy is above said second predetermined limit.

15. The apparatus defined by claim 14 wherein said predetermined feedback signal is a tone.

16. The apparatus defined by claim 14 further comprising distortion generator means and wherein said predetermined feedback signal is input speech detected by said speech detection means distorted by said distortion generator means.

17. The systems defined by claim 1 wherein said input speech energy is an average of the input speech energy.

18. The systems defined by claim 6 wherein said input speech energy is an average of the input speech energy.

19. The system defined by claim 9 wherein said input speech energy is an average of the input speech energy.

20. The system defined by claim 14 wherein said input speech energy is an average of the input speech energy.

* * * * *